US009644861B2

(12) United States Patent
Siegel et al.

(10) Patent No.: US 9,644,861 B2
(45) Date of Patent: May 9, 2017

(54) GAS HEAT SUB-BASE FOR PACKAGED TERMINAL AIR CONDITIONER

(71) Applicants: Moshe M. Siegel, Piermont, NY (US); Fredric D. Nadel, Westport, CT (US)

(72) Inventors: Moshe M. Siegel, Piermont, NY (US); Fredric D. Nadel, Westport, CT (US)

(73) Assignee: INTERNATIONAL GAS HEATING EQUIPMENT LLC, Wilmington, DE (US)

( * ) Notice: Subject to any disclaimer, the term of this patent is extended or adjusted under 35 U.S.C. 154(b) by 1042 days.

(21) Appl. No.: 13/788,313

(22) Filed: Mar. 7, 2013

(65) Prior Publication Data

US 2014/0251575 A1 Sep. 11, 2014

(51) Int. Cl.
*F25B 29/00* (2006.01)
*F24F 13/20* (2006.01)

(52) U.S. Cl.
CPC ..... *F24F 13/20* (2013.01)

(58) Field of Classification Search
USPC ..... 126/99 R; 237/50, 55; 165/59
See application file for complete search history.

(56) References Cited

U.S. PATENT DOCUMENTS 2,813,406 A 11/1957 Smith
2,945,627 A * 7/1960 McDermott ..... F25B 39/04 239/215
3,228,459 A 1/1966 Crooker et al.
3,251,540 A 5/1966 Kinsworthy
3,326,276 A 6/1967 Wilhoite
3,366,169 A 1/1968 Laing
3,695,345 A 10/1972 Moreland
3,865,182 A 2/1975 Blossom
4,443,389 A * 4/1984 Dodds ..... F28B 1/06 138/38
4,637,223 A 1/1987 Hosoya et al.
4,733,543 A 3/1988 Blair
4,773,589 A * 9/1988 Boyd ..... F24B 1/18 126/502
4,951,737 A 8/1990 Tenhundfeld et al.
5,038,751 A * 8/1991 Riedling ..... F24H 3/0488 126/110 C
5,295,531 A 3/1994 Tsunekawa et al.
5,775,408 A 7/1998 Shimek et al.
7,802,615 B2 9/2010 Martinus et al.
8,141,791 B2 3/2012 Rosen
(Continued)

OTHER PUBLICATIONS

Suburban Dynaline 3, http://www.suburbanmanufacturing.com/, 2 pgs., 2012, Airxcel, Inc.

(Continued)

*Primary Examiner* — Avinash Savani
(74) *Attorney, Agent, or Firm* — Blank Rome LLP

(57) ABSTRACT

A gas heat sub-base for use in conjunction with a PTAC or similar HVAC terminal unit, the sub-base having a housing with a front side, back side, top and bottom all defining an interior space. The top is configured to mate with the bottom of the PTAC unit. The sub-base also includes a plurality of air intake louvers on the front side of the housing and a heat exchanger located within the interior space of the housing. The gas heat sub-base is separate from, but is integrated with, the PTAC unit. A heating and cooling unit includes a PTAC unit with the gas heat sub-base.

18 Claims, 5 Drawing Sheets

(56) References Cited

U.S. PATENT DOCUMENTS

| | | | | |
|---|---|---|---|---|
| 8,978,639 | B2 * | 3/2015 | Halverson | F24C 3/002 126/515 |
| 2011/0226443 | A1 | 9/2011 | Siegel et al. | |

OTHER PUBLICATIONS

McQuay International, Applied Packaged Terminal Air Conditioner and Heat Pumps, Catalog 1300-2, pp. 12, 13 & 30, 4 pgs.

* cited by examiner

GAS HEAT SUB-BASE FOR PACKAGED TERMINAL AIR CONDITIONER

FIELD OF THE INVENTION

The present application relates to a gas heat sub-base to be used in conjunction with various HVAC terminal units, including packaged terminal air conditioners ("PTAC").

BACKGROUND OF THE INVENTION

Conventional PTAC units are compact, self-contained cooling and heating systems commonly designed to fit within an opening in the wall of a building. One such conventional PTAC unit is sold under the name AIRXCEL, which is made by Suburban Manufacturing, as described at www.suburbanmanufacturing.com, the contents of which are hereby incorporated by reference. The front of the PTAC unit extends into the space to be conditioned, and the back of the PTAC unit extends through the wall opening to the outside of the building, allowing for the intake and exhaust of condenser and room ventilation air. The PTAC contains a sealed unitary refrigeration system, indoor and outdoor motor/blower assemblies, room cabinet with a discharge grille to discharge conditioned air into the room, and a controller to operate the unit in different modes and sense the room temperature.

PTAC units typically provide both heating and cooling, using electric power to cool and a variety of options for heating, including electric heat, reverse cycle heat pump, hydronic (hot water or steam) heat or gas heat. One disadvantage of PTAC units with the heating system integrated into the unit chassis is that the entire unit chassis needs to be removed when repair or replacement of only the heating or cooling system is needed.

SUMMARY OF THE INVENTION

An object of the present invention is to provide a separate heating sub-base which is used with each PTAC unit, and which shares common controls, power wiring, indoor air handling sections, and exhaust and intake openings. In this way, the cooling unit is already in place and the gas heat unit can be easily integrated. The present invention provides a sub-base which also increases the heating efficiency of the existing PTAC unit.

A gas heat sub-base is provided for use in conjunction with a PTAC or similar HVAC terminal unit, the sub-base having a housing with a front side, back side, top and bottom all defining an interior space. The top is configured to mate with the bottom of the PTAC unit. The sub-base also includes a plurality of air intake louvers on the front side of the housing and a heat exchanger located within the interior space of the housing. The gas heat sub-base is separate from, but is integrated with, the PTAC unit. A heating and cooling unit includes a PTAC unit with the gas heat sub-base.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
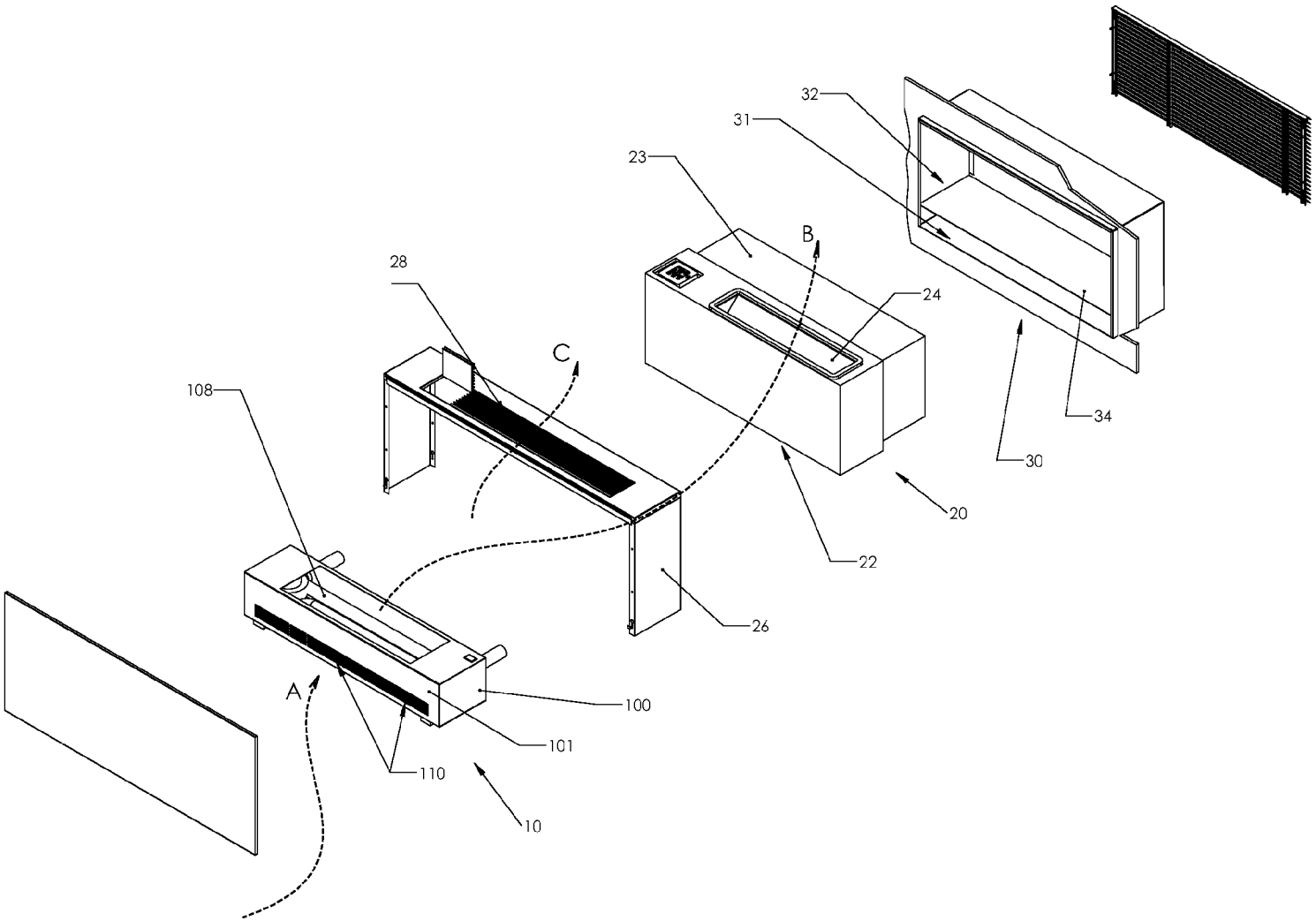
FIG. 1 is an exploded elevational view of a gas heat sub-base conjoined to a PTAC unit in accordance with an exemplary embodiment of the present invention.

In describing a preferred embodiments of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

Referring to the drawings, FIG. 1 shows a gas heat sub-base 10 in accordance with the present invention. The sub-base 10 is particularly designed to be used in conjunction with an existing PTAC unit 20. The gas heat sub-base 10 is a heating unit that supplies heat generated from the combustion of natural gas heat or propane to a room, while an existing PTAC unit 20 is employed for cooling, air handling for heating and room ventilation and controlling and powering the unit operating mode and room temperature sensing. A room enclosure cabinet 26 is provided to enclose the top, sides and front of both the PTAC unit 20 and the sub-base unit 10. The PTAC unit 20 includes a condenser section at its rear that is slid into a wall sleeve 30. The PTAC 20 has a housing or chassis 100 (FIG. 2) that is attached to the wall sleeve 30 by mechanical fasteners. The gas sub-base 10 is connected to gas service and secured to the wall sleeve 30 by mechanical fasteners.

As shown, the PTAC unit 20 consists of a sheet metal housing and an integral cooling assembly. The PTAC unit 20 typically has an air intake 22 located on the bottom of the unit in order to draw in room air to be conditioned. Air is circulated by an internally mounted motor/blower assembly. Additionally, the PTAC unit 20 includes internal wiring and electrical/electronic controls and a power cord and plug to provide power to the unit and the sub-base.

Figure 2:
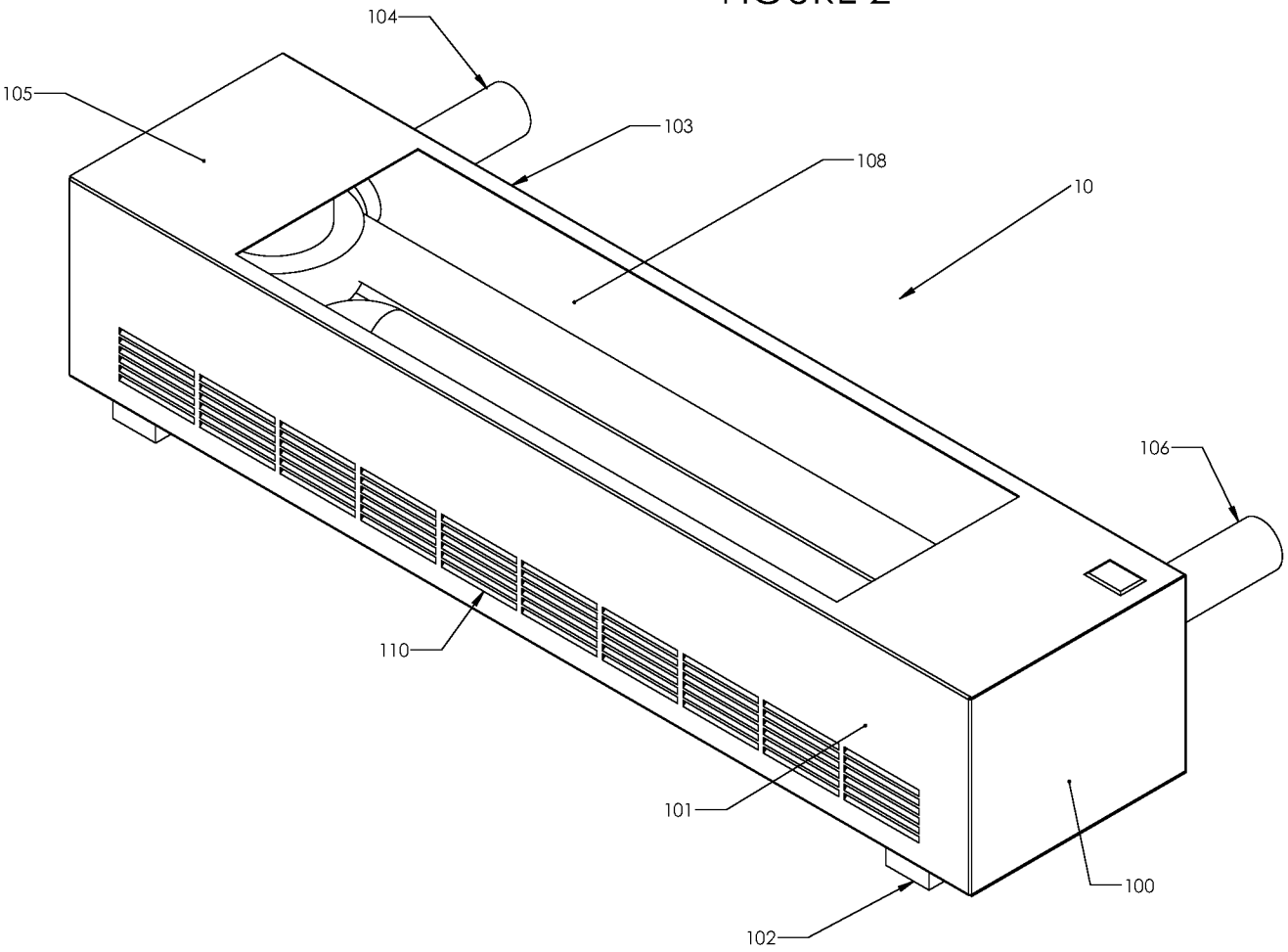
FIG. 2 is an elevational view of the gas heat sub-base illustrated in FIG. 1.
Figure 3:
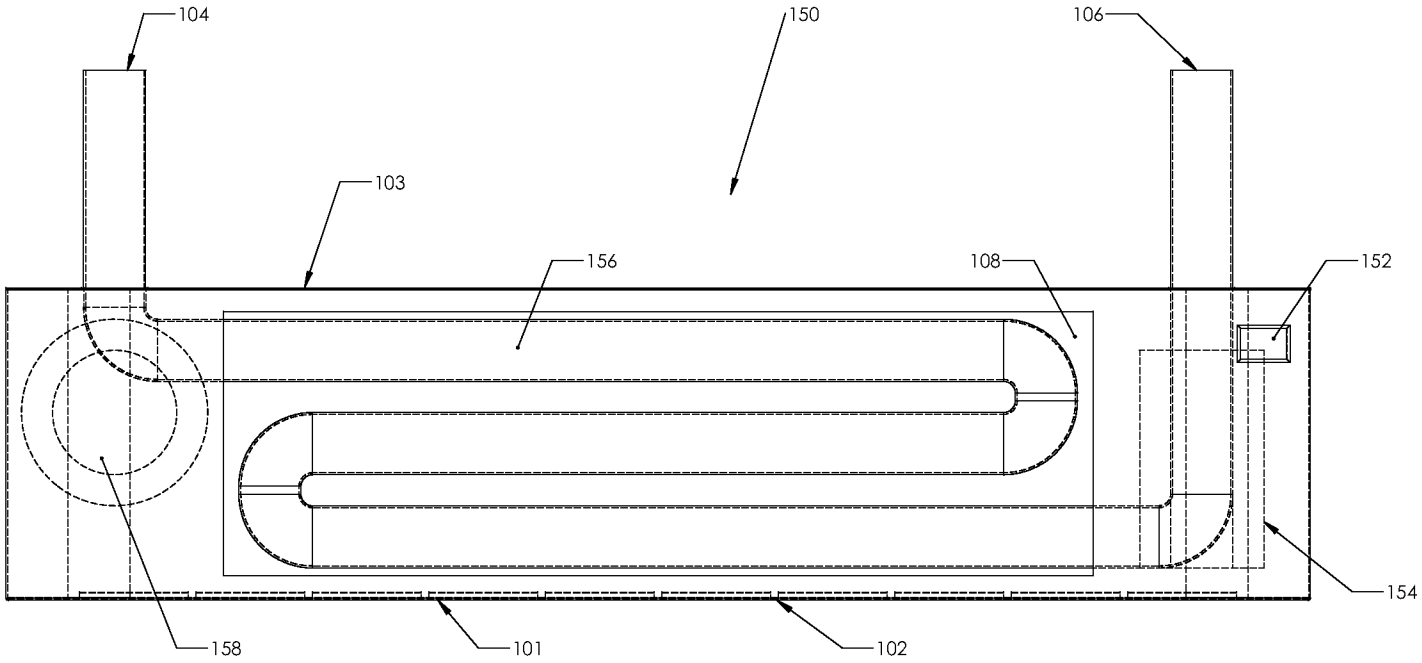
FIG. 3 is a top plan view of the gas heat sub-base illustrated in FIG. 1.

As best shown in FIGS. 2 and 3, the gas heat sub-base 10 generally includes a housing 100 and a heating assembly 150. The housing 100 forms an enclosure of the sub-base 10. The housing 100 is sized and shaped to conform to the size and shape of the indoor side of the PTAC unit 20, and especially the width and depth of the sub-base housing 100 is substantially the same as the width and depth of the PTAC unit 20. Accordingly, the sub-base housing 100 is generally rectangular in shape, and has a front side 101, back side 103, top surface 105 and bottom surface 107 (FIG. 4), all of which define an interior space. The housing 100 also has a rectangular-shaped opening 108 on its top surface 105 to communicate air between the interior space of the sub-base 10 and the PTAC unit 20. It should be appreciated, however, that the housing 100 need not be rectangular, but can be any suitable size and shape, preferably conforming to the size and shape of the PTAC unit 20.

As shown in FIGS. 1, 2 and 3, the sub-base housing 100 includes an intake flue 106, an exhaust flue 104, an opening 108 on the top surface 105 of the housing 100, and a plurality of room air intake louvers 110. The housing 100 is preferably made of sheet metal. The housing 100 is sized and configured to fit below the PTAC unit 20 with the top portion of the sub-base 10 aligning with the bottom portion 31 of the wall sleeve 30, so that the intake 106 and exhaust 104 tubes protrude through the lower section 31 of the wall sleeve 30 to the outside of the building.

As best shown in FIG. 1, the wall sleeve 30 has a rectangular shape defined by two longitudinal sides and two lateral sides. It has a depth sufficient to extend through a wall to present an opening from an inside of the building to the exterior of the building. The wall sleeve has a divider panel 34 extending parallel to the longitudinal sides. The divider panel 34 separates the interior of the wall sleeve 30 into a top section 32 and a lower section 31, both of which have a rectangular shape. The divider panel 34 is located toward the bottom of the lateral side walls of the wall sleeve 30, such that the lower section 31 is substantially smaller than the upper section 32. The lower section 31 is sized and shaped to receive an exhaust flue 104 and an intake flue 106 of the sub-base unit 10. The exhaust 104 and intake 106 are preferably long enough to extend through the entire sleeve 30 to the outside of the building. The exhaust 104 and intake 106 can thereby communicate air with the outside of the building. The sub-base is supported by resting on the floor of the room on the four adjustable height legs, and through an attachment to the wall sleeve. It does not enter the wall sleeve. The upper section 32 is sized and shaped to match the size and shape of the condenser 23 so that the condenser 23 can be fully received in the upper section 32. The condenser 23 can thereby communicate air with the outside of the building.

The wall sleeve 30 has an upper section 32 that has a slightly larger height and width dimensions than the PTAC chassis condenser section 23 with a variable depth that is matched to building wall depths. Accordingly, the PTAC 20 is mounted in the upper section 32 of the wall sleeve 30, and the sub-base 10 is mounted against the lower section 31 of the wall sleeve 30. The sleeve 30 aligns the opening 108 in the top of the sub-base 10 with the intake opening in the bottom of the PTAC 20, so that air can be communicated between the PTAC 20 and the sub-base 10. The sub-base 10 is mounted against the interior wall of the room and its depth is generally equal to or slightly deeper than the PTAC unit housing 100 has roughly the same width and depth as the inroom section of the PTAC unit 20.

The top, bottom and sides of the housing 100 form an enclosure to operate as a plenum chamber, such that air is drawn into the sub-base 10 through the intake louvers 110 and directed to the conjoined PTAC unit 20 via the opening 108, without escaping through the sides or elsewhere on the housing 100. Further, both the intake flue 106 and the exhaust flue 104 extend from the back side 103 of the housing 100 and ultimately into the wall sleeve 30, thus being exposed to the outside environment. Accordingly, both the PTAC unit 20 and the sub-base unit 10 share the same wall sleeve 30 to have both intake and exhaust to the outside of the building. Though the sub-base 10 and the PTAC unit 20 use the wall sleeve 30 for air intake and exhaust, it should be recognized that they employ two separate sections 31, 32 of the wall sleeve 30 for this purpose—with the PTAC chassis 23 using the upper section 32 and the sub-base 10 using the lower section 31.

Figure 4:
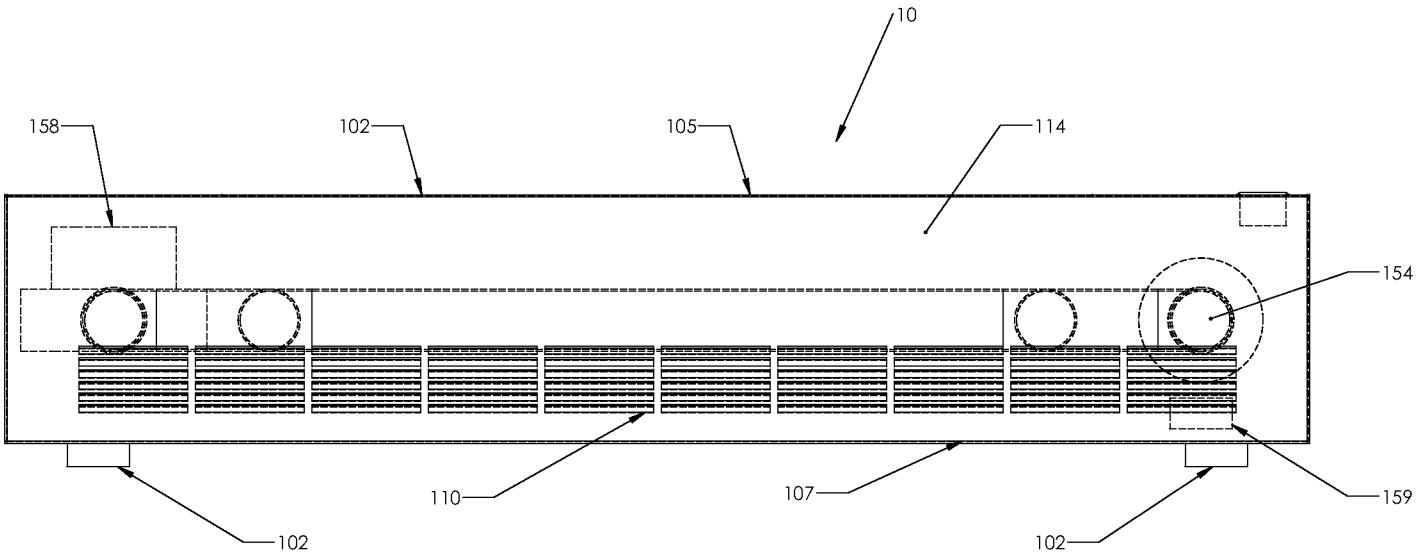
FIG. 4 is a front plan view of the gas heat sub-base illustrated in FIG. 1.

According to one embodiment, as shown in FIGS. 1, 2 and 4, the housing 100 has a plurality of adjustable legs 102 affixed to the bottom surface 107 to support the sub-base 10 on the floor. Preferably, the housing 100 has four adjustable legs 102 located at each corner of said housing 100 that can be raised or lowered to make contact with the floor, such that the legs 102 partially support the weight of the sub-base 10 and the sub-base 10 can be aligned with the PTAC unit 20.

A rectangular-shaped opening 22 is provided on the bottom of the PTAC unit 20 to communicate air between the sub-base unit 10 and the PTAC unit 20. The PTAC opening 22 is substantially the same size and shape as the sub-base opening 108, in order to communicate air with the sub-base 10. According to one embodiment, the gas heat sub-base 10 is removably coupled to the bottom of the PTAC unit 20, such that the opening 108 on the top surface 105 of the housing 100 aligns with the opening 22 on the bottom of the PTAC unit 20. The mechanical attachment of the sub-base 10 and the chassis to the wall sleeve 30 assures a close alignment between the parts. The air flow from the chassis mounted motor/blower assembly above creates negative pressure that pulls the air through the sub base and into the PTAC chassis. Preferably, the sub-base 10 is positioned below the PTAC unit 20 instead of above to allow for proper air flow through the sub-base 10 into the PTAC chassis 20. Because hot air rises, and because the PTAC blower creates a negative pressure through the heat exchanger to pull the air through, this is the preferred location of the sub-base.

As depicted in FIGS. 3 and 4, the gas heat sub-base 10 also includes a heating assembly 150. The heating assembly 150 is located within the interior space of the housing 100. The heating assembly 150 generally has a wiring connector 152, a fuel gas valve 159, a heat exchanger 156, a motor and blower assembly 158, and a burner assembly 154. The wiring connector 152 is electrically connected to the PTAC controller to provide power to the sub-base motor/blower assembly and to receive and send control signals from/to the controller to perform operation and safety checks of the sub-base unit 10. The fuel gas valve 159 is located adjacent to the burner assembly 154, and controls the flow of natural gas or propane from the building gas piping system into the burner assembly 154. The combusted gas/air mixture then flows through the heat exchanger 156, heating the room air being pulled through the sub-base by the PTAC blower. The interior space of the housing 100 may also include an access area for fuel gas piping and wiring, in order to provide adequate delivery of the fuel gas to the fuel gas valve 159 and to properly monitor and control the combustion process.

The motor and blower assembly 158 is located at one end of the housing 100, while the burner assembly 154 is located at the opposite end of the housing. The heat exchanger 156 is typically an elongated S-curved pipe that is coupled at one end to the motor and blower assembly 158, and at the other end to the burner assembly 154. The heat exchanger 156 is positioned at the middle section of the housing 100, and extends between the motor/blower assembly 158 and the burner assembly 154 along the length of the housing 100. The heat exchanger 156 is aligned directly below the opening 108, such that it heats air being pulled through the sub-base 10 and minimizes air obstruction. The intake flue 106 is coupled to an opposing end of the burner assembly 154, while the exhaust flue 104 is coupled to an opposing end of the motor and blower assembly 158.

In operation, the PTAC unit 20 is wired and programmed to have a heating mode. In the heating mode, a controller located within the PTAC unit 20 or within the sub-base 10 is activated. The heat controller includes a sensor that reads the room air temperature and compares it to the preset desired temperature. If the room is cooler than the preset temperature, the heat controller transmits a control signal that opens the fuel gas valve 159, allowing the flow of natural gas or propane to the burner assembly 154, as shown in FIGS. 3 and 4. At the same time, the control signal causes the motor and blower assembly 158 of the sub-base 10 to be activated. The motor and blower assembly 158 draws in air from the outside through the intake flue 106, which mixes with the fuel gas. A signal from the heat controller to the fuel ignition system contained within the burner assembly 154 initiates combustion of the fuel and intake air within the burner assembly. The heated and combusted gas and air mixture is then pulled through the heat exchanger 156. Because the heat exchanger 156 is made of a thermally conductive metal, the presence of the hot combusted gas and air mixture heats the heat exchanger 156. Lastly, the combusted gas and air mixture is exhausted through the exhaust flue 104 by the motor and blower assembly 158 to the outside environment.

Simultaneously, the PTAC indoor fan is activated by the control signal from the PTAC controller. The fan draws in air from the room to be heated through the sub-base air intake louvers 110, as represented by line A in FIG. 1. The opening 108 on the top surface 105 of the housing 100, and the opening 22 on the bottom of the PTAC unit 20, permits the PTAC indoor fan to draw in room air through the room air intake louvers 110, whereby the sub-base unit 10 operates as a plenum. As the room air is pulled in through the louvers 110, it is heated as it passes across the heat exchanger 156.

As shown by line B in FIG. 1, the heated air is then pulled through the opening 108 in the top of the sub-base unit 10, into the PTAC unit 20, where it is then expelled into the room to be heated through the output vent 24 on the top surface of the PTAC unit 20. Thus, the sub-base 10 does not require or have its own indoor fan or output vent, but rather shares the fan and output vent 24 of the PTAC unit 20. As shown in FIG. 1, by line C, the PTAC unit 20 may include a front cover 26 also having air vents 28 to allow for the release of the heated air.

The opening 108 on the top surface 105 of the housing 100 is aligned with the matching opening 22 on the bottom of the PTAC unit 20. The two openings cooperate to allow the room air to communicate with (and be controlled by) the PTAC indoor fan. The PTAC indoor fan directs the movement of the room air through the heating elements 150. The sub-base 10 also utilizes the internal PTAC wiring and electrical controls for powering and controlling the motor and blower assembly 158 (which circulates combusted air), and for controlling the burner assembly 154 and fuel gas value 159. The necessary electrical wiring is routed to the sub-base 10 through the wiring connector 152, as shown in FIG. 3, via a mating connector that originates from, and is attached to, the PTAC unit 20 itself. The PTAC controller is connected by wiring to the PTAC interior fan, wiring connector 152, motor/blower assembly 158, and burner 154. The control commands originate within the PTAC controller, which can be a PC Board or mechanical controls, and are transmitted through internal PTAC wiring to the PTAC unit motor/blower assembly 158 and through the wiring connector 152 to the sub-base components—burner/ignition system (which has a separate electronic controller for combustion/ignition/safety controls), exhaust motor/blower etc.

Figure 5:
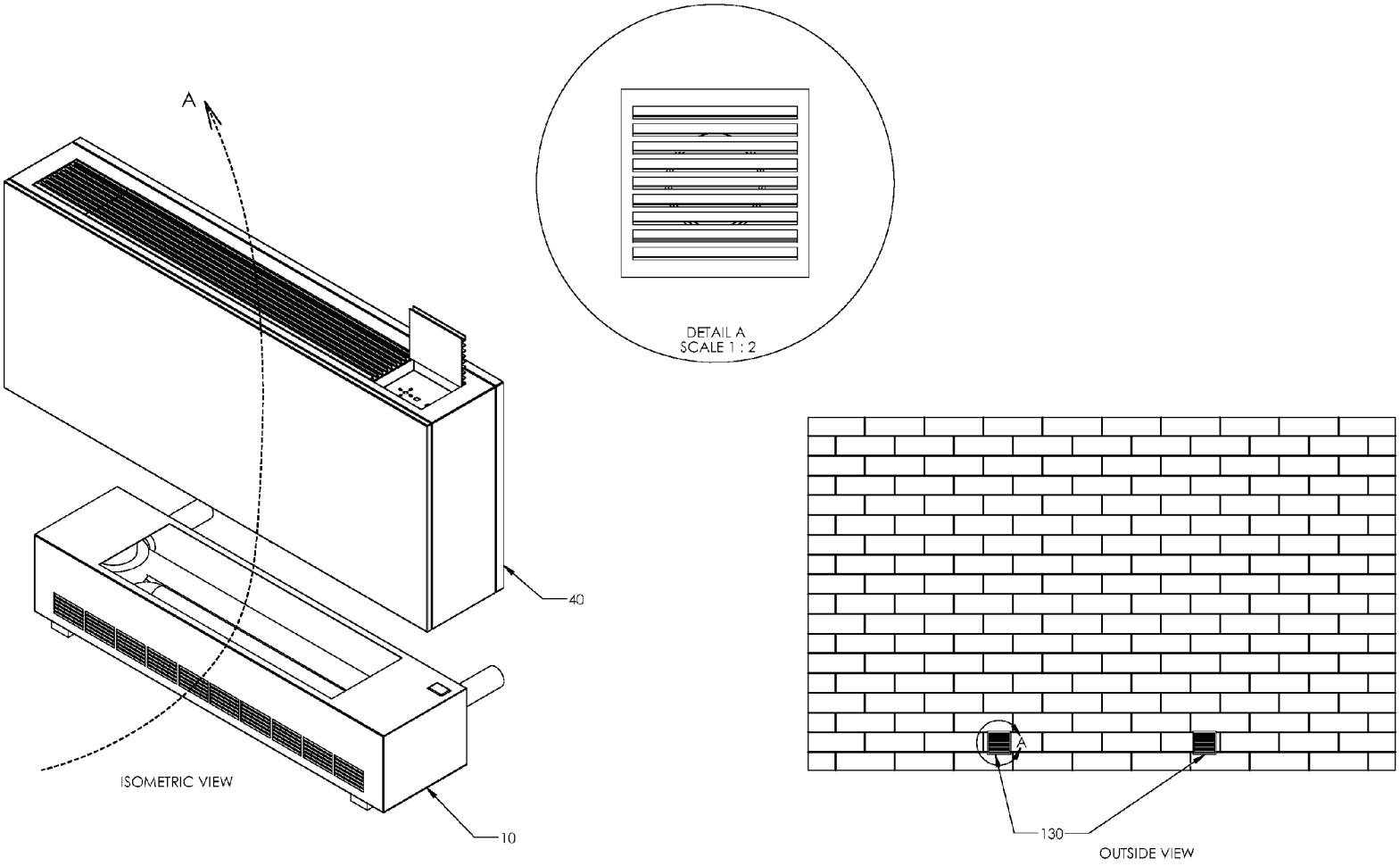
FIG. 5 shows the sub-base for use with a fan coil unit in accordance with another embodiment of the invention.

Additionally, the gas heat sub-base 10 uses a compartment located within the bottom of the PTAC wall sleeve 30 for air intake and gas exhaust. Specifically, the motor and blower assembly 154 of the sub-base 10 intakes air through the intake flue 106 and expels exhaust gas through the exhaust flue 104. For a PTAC application, no new exhaust or intake wall openings are needed for the sub-base 10, as it shares the openings of the PTAC unit 20. For other types of HVAC equipment, separate flue intake and exhaust openings may be required, as shown in FIG. 5.

According to one embodiment, the housing 100 may be about 8 inches high, about 10 inches deep, and about 42-48 inches wide, and the PTAC chassis is 9.25 inches deep, 16.75 inches in height, and 42 inches wide. The size of the housing 100 allows the sub-base 10 to fit between the PTAC unit (which is located within the wall), and the floor of the room to be heated or cooled. The housing 100 may be designed with any size which is suitable for this purpose, and which is known by one skilled in the art.

The sub-base 10 is more efficient than traditional stand-alone or integrated heating systems because it can utilize already existing components of the PTAC unit 20. Should the PTAC unit 20 or sub-base 10 need repair or replacement, it can be removed without disruption to the other unit. In addition, either the PTAC unit 20 or sub-base 10 can be installed prior to the installation of the other, or both can be installed simultaneously. However, the preferred sequence of installation is that the wall sleeve 30 is installed during wall construction. Then the sub-base 10 is piped and set in place aligning with the wall sleeve 30, with the intake 106 and exhaust 104 flues located in the lower wall sleeve section 31. The exterior louver (attached to the sleeve 30 as an exterior finish piece) is then installed. Next, the PTAC unit 20 and the room enclosure 26 are installed. Further, as discussed above, the present invention shares integral components with the independent cooling system. For example, the sub-base 10 need not have its own room air handling components or intake and exhaust wall openings, but instead shares these components with the PTAC unit 20. Additionally, the sub-base 10 shares the output vent 24 of the PTAC unit 20, such that the same output vent 24 is used to expel both hot and cold air, reducing the amount of wall space required. In this way, the present invention is advantageous because it operates more efficiently than two separate heating and cooling systems, but is also easier to maintain and repair than completely integrated heating and cooling systems. In addition, the sub-base 10 and PTAC 20 have shared controls and power wiring. Thus, the sub-base 10 does not require separate heat and cool controls, but instead utilizes those of the PTAC 20 and has a wiring connector 152 to accept the control signals from the PTAC controller. The present invention also provides an efficient and cost effective construction process, allowing for a staged installation of the required components as construction progresses, while not exposing the finish pieces such as the room cabinet 26 to be exposed to damage during the construction process. It is also more compact than two separate systems. The cooling chassis 23 is more efficient than a unit with the gas heat system integrated into the chassis, as it allows for larger refrigeration coils, more efficient cooling heat transfer and higher efficiencies—i.e. it is a greener, more efficient system that meets the more aggressive efficiency standards required to meet updated building codes and government regulations.

In addition, a Carbon Monoxide detector with gas valve interlock can be integrated into the unit. This can be located in the sub-base 10 or the PTAC unit 20. Alternatively, it could be located elsewhere in the room or building and communicate through radio frequency signals, hardwire, or similar methods.

The invention has been shown and described for use with PTAC units. For instance, the gas heat sub-base is connected to an existing PTAC unit and utilizes some of its components, including the indoor fan and motor and the wall openings of the PTAC unit. The gas heat sub-base supplies heat generated from natural gas or propane combustion to a room to be heated. However, it should be appreciated that other types of terminal HVAC equipment can be utilized with the sub-base of the present invention, such as fan coil units (FCU) 40 and water source heat pumps (WSHP), provided that these units are properly wired and connected to the sub-base to allow for the powering and control of the sub-base functions. As shown in FIG. 5, the gas heat sub-base system 10 can be applied to other types of room HVAC units, such as Fan Coil Units (FCU) 40 or Water Source Heat Pump Units (WSHP) and similar room terminal equipment that lack a sleeve, therefore requiring dedicated intake and exhaust flue openings.

While particular embodiments have been chosen to illustrate the invention, it will be understood by those skilled in the art that various changes and modifications can be made therein without departing from the scope of the invention as defined in the appended claims.

What is claimed is:

1. A gas heat sub-base assembly for use with a packaged terminal air conditioner (PTAC) unit, or similar heating, ventilation, and air conditioning (HVAC) terminal equipment having a PTAC housing with a bottom, an indoor fan and an output vent located at the top of the PTAC housing for distribution of air, said gas heat sub-base assembly comprising:

an assembly housing having a front side, back side, top and bottom, all defining an interior space, said top having a top surface configured to mate with the bottom of the PTAC unit;

an opening on said top surface of said assembly housing aligned with the bottom of the PTAC housing and communicating air with the PTAC unit or the HVAC terminal;

a plurality of air intake louvers positioned on said assembly housing; and a heating assembly located within the interior space of said assembly housing, whereby the indoor fan of the PTAC unit pulls air through said plurality of air intake louvers, across said heating assembly, and out through the output vent via said opening.

2. The gas heat sub-base according to claim 1, wherein said gas heat sub-base utilizes the indoor fan and the output vent of the PTAC unit, such that said sub-base and the PTAC unit are integrated.

3. The gas heat sub-base according to claim 1, wherein said gas heat sub-base does not have a separate indoor fan or output vent.

4. The gas heat sub-base according to claim 1, wherein said gas heat sub-base is separate from, and removably coupled to, the PTAC unit and a PTAC wall sleeve.

5. The gas heat sub-base according to claim 1, wherein the PTAC unit further comprises internal wiring and electrical controls.

6. The gas heat sub-base according to claim 5, further comprising a wiring connector located on said housing to connect the internal wiring, electronic and electrical controls of the PTAC unit to said sub-base.

7. The gas heat sub-base according to claim 1, further comprising:

an intake flue extending from said back side of said housing; and an exhaust flue extending from said back side of said housing.

8. The gas heat sub-base according to claim 7, further comprising a wall sleeve configured to extend through a wall opening, said wall sleeve having an upper section for retaining a condenser of the PTAC unit, and a lower section through which said intake flue and said exhaust flue extend to an outside environment, and a divider panel separating said lower section from the upper section.

9. The gas heat sub-base according to claim 1, further comprising:

a fuel gas valve located within said interior space of said housing;

a burner assembly located within said interior space of said housing with integral ignition system;

a heat exchanger located within said interior space of said housing; and a motor and blower assembly located within said interior space of said housing.

10. The gas heat sub-base according to claim 1, further comprising a casing located on said front surface of said housing.

11. The gas heat sub-base according to claim 10, wherein said plurality of air intake louvers is located on said casing.

12. The gas heat sub-base according to claim 1, further comprising a plurality of adjustable legs on said bottom of said housing.

13. The gas heat sub-base according to claim 1, further comprising a heat controller.

14. The gas heat sub-base according to claim 1, further comprising an access area in said interior space of said housing for fuel gas piping and wiring.

15. The gas heat sub-base according to claim 1, wherein said housing is about 8 inches in height, about 10 inches in depth, and about 42-48 inches in width.

16. A conjoined heating and cooling unit, comprising:

a packaged terminal air conditioner (PTAC) unit having a bottom, an indoor fan and an output vent for distribution of air, wherein the output vent is located at the top of the PTAC unit; and a gas heat sub-base including, a housing having a front side, back side, top and bottom, all defining an interior space, said bottom configured to mate with said bottom of said PTAC unit;

an opening on said top of said housing for communicating air with said PTAC unit;

a plurality of air intake louvers positioned on said housing; and a heating assembly located within said interior space of said housing, whereby said indoor fan of said PTAC unit pulls air through said plurality of air intake louvers, across said heating assembly, and out through said output vent.

17. A method of heating a room, comprising the steps of:

providing a packaged terminal air conditioner (PTAC) unit having a bottom, an indoor fan, an output vent for distribution of air and a wall opening for air intake and exhaust, wherein the output vent is located at the top of the PTAC unit;

providing a gas heat sub-base including, a housing having a front side, back side, top and bottom, all defining an interior space, said bottom configured to mate with said bottom of said PTAC unit;

an opening on said top of said housing for communicating air with said PTAC unit;

a plurality of air intake louvers positioned on said housing;

an exhaust flue extending from said back side of said housing and through said wall opening of said PTAC unit;

an intake flue extending from said back side of said housing and through said wall opening of said PTAC unit;

a heat exchanger located within said interior space of said housing;

a fuel gas valve located within said interior space of said housing;

a burner assembly located within said interior space of said housing;

an integral ignition system and fuel ignition and gas controller located within said interior space of said housing; and a motor and blower assembly located within said interior space of said housing;

delivering combustible gas to said fuel gas valve to ignite said burner assembly;

drawing air into said sub-base through said intake flue using said motor and blower assembly, causing said air to combust when contacting said burner assembly;

drawing said combusted air through said heat exchanger;

drawing room air into said sub-base through said plurality of air intake louvers using said PTAC indoor fan;

drawing said room air across said heat exchanger to heat said room air;

delivering said heated room air to room through said output vent on said PTAC unit; and expelling combusted air through said exhaust flue.

18. The gas heat sub-base assembly of claim 1, wherein the PTAC housing has a front side, back side, top and bottom, all defining an interior space, said bottom having a bottom surface configured to mate with the top of the assembly housing.

* * * * *